137-13
11/21/78 XR 4,126,542

United States Patent [19]

Carlsmith

[11] 4,126,542

[45] Nov. 21, 1978

[54] PRESSURE DROP DEVICE FOR FLUID SUSPENSIONS

[75] Inventor: Lawrence A. Carlsmith, Amherst, N.H.

[73] Assignee: Canadian Ingersoll-Rand Company, Montreal, Canada

[21] Appl. No.: 789,922

[22] Filed: Apr. 22, 1977

[51] Int. Cl.[2] ..... B07B 1/46

[52] U.S. Cl. ..... 209/258; 137/13

[58] Field of Search ..... 209/211, 10, 256, 258, 209/273; 137/13, 604

[56] References Cited

U.S. PATENT DOCUMENTS

| | | | |
|---|---|---|---|
| 2,631,759 | 3/1953 | Hoopes | 137/13 X |
| 2,794,832 | 6/1957 | Rietema | 209/211 X |
| 3,039,608 | 6/1962 | Wikdahl | 209/211 |
| 3,337,050 | 8/1967 | Labecki | 209/211 |
| 3,410,409 | 11/1968 | Rittenhouse et al. | 209/256 |
| 3,426,534 | 2/1969 | Murphy | 137/13 X |
| 3,928,187 | 12/1975 | Young | 209/273 X |

*Primary Examiner*—Frank W. Lutter
*Assistant Examiner*—Ralph J. Hill
*Attorney, Agent, or Firm*—Frank S. Troidl

[57] ABSTRACT

A flow comprising solid particles in a fluid suspension under pressure, typically the rejects flow from a separator, is conducted to a vortex flow chamber. In the vortex flow chamber, added liquid flow is caused to whirl and the reject flow containing contaminants is squeezed towards the axis of the vortex flow chamber and accelerated axially. This prevents plugging of a flow control valve connected to the vortex flow chamber outlet.

3 Claims, 5 Drawing Figures

PRESSURE DROP DEVICE FOR FLUID SUSPENSIONS

This invention relates to the pulp and paper technology. More particularly, this invention provides improved operation of a screening system.

In the preparation of wood pulp, wood usually in the form of wood chips is chemically treated and cooked in a digester to dissolve most of the lignin, leaving desired cellulose fibers, which can be reformed into paper. Often the pulp slurry from the digester contains incompletely cooked chips, together with other foreign matter or contaminants. Incompletely cooked chips, knots, bolts, stones, sand and so forth must be removed from the pulp slurry to produce top quality pulp, as well as to protect subsequent equipment.

One method of removing the contaminants is to use a separator under hydraulic pressure. The separator usually includes a perforated screen through which the oversized material will not pass. The oversized materials or contaminants are conducted away from the separator in a dilute liquid suspension, which also may contain a significant proportion of good fibre. It is important that the amount of good fibre discharged should be minimized. Typically, satisfactory operation of the separator may be attained with rejects discharged at a flow rate between 100 and 300 gpm and with a pressure between 10 and 40 psig.

The reject flow must be discharged finally at atmospheric pressure, and a flow control system utilizing a throttling valve normally provides the necessary drop in pressure at a controlled flow rate. However, the size range of the contaminants is usually such that a flow rate of 500 gpm or greater is necessary to provide a valve opening large enough to reduce significantly the frequency of interruption of operation due to jamming of particles in the valve opening. It is noted that normal flow control systems, including the most modern electronic types, do not react sufficiently quickly to prevent such plugging. However, even with the increased flow rate, interruptions of operation may still occur due to the jamming of cooperating sets of particles in the valve opening.

Clearly, the addition of fluid to the reject conduit between the separator and the valve will reduce the frequency of valve plugging while permitting the minimum fibre loss, however, interruptions of operation can still occur due to the jamming of sets of particles in the valve opening.

Furthermore, the contaminants in general, and in particular those of mineral origin such as sand, grit, and gravel, cause abrasive wear of the valve elements such that additional costs and downtime are involved for repair work.

The invention provides means for the addition of fluid to the reject conduit in such a way as substantially to eliminate jamming of sets of particles in the opening of a valve or other restriction, and to provide a major reduction in wear of the members of the valve or restriction.

Furthermore, when the vortex cooperates with a fixed restriction such as an orifice or following section of reduced bore conduit, the capability is provided for controlling the reject flow rate by varying the dilution fluid flow rate, thereby simplifying the flow control system and permitting the use of equipment of lower cost than otherwise would be required.

Briefly described, this invention includes a vortex chamber connected under hydraulic pressure to a source of solid particulate material in a fluid suspension, to a flow restrictor and to a source of dilution fluid. In the example, the source of contaminants may be a separator. A conduit means flows the fluid containing the contaminants and fibre from the separator to an axial connection of the vortex chamber. A second conduit means flows dilution fluid at relatively greater velocity into a tangential connection of the vortex chamber. A further axial connection provides means for discharging the total flow into a pressure dissipating device such as a partially closed valve or other restriction. The dilution fluid surrounds the reject flow and, due to the centrifugal force created by its greater tangential component of velocity, squeezes the reject flow into a smaller cross section without significant mixing as both flows pass along the converging passage preceding discharge from the vortex chamber. The resulting axial acceleration of the fluid containing contaminants has a beneficial effect in causing the longer sliver like particles to become aligned in the direction of flow. At the entry to the valve or other restriction the reject flow containing the contaminants and fibre is surrounded by a substantial annular layer of dilution fluid free of large contaminants. Thus the contaminants pass through the restriction with such few contacts that structures of contaminants are unable to form across the restriction, and erosive wear is largely reduced.

The invention, as well as its many advantages, may be further understood by reference to the following detailed description and drawings in which.

Like parts in the various Figures are referred to by like numbers.

Figure 1:
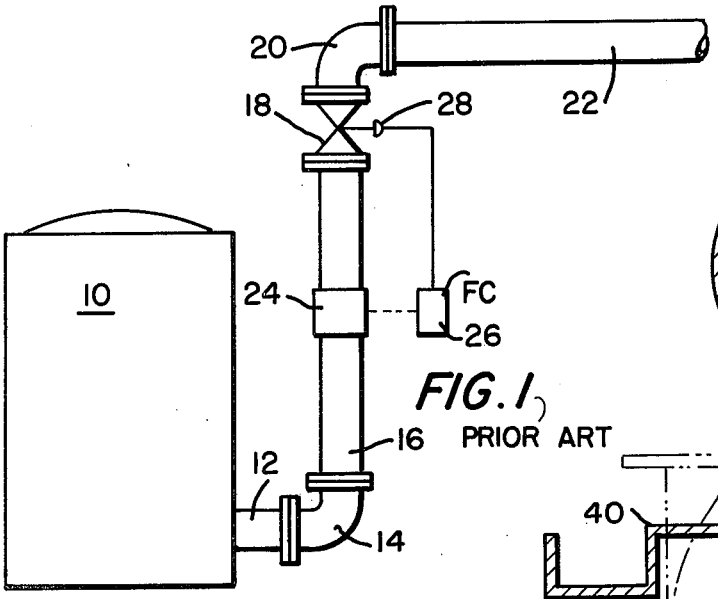
FIG. 1 PRIOR ART
FIG. 1 is a schematic view illustrating a conventional screening system.

Referring to the drawings, and particularly to FIG. 1, a conventional screening system including a separator 10 is schematically illustrated. In the separator, the pulp slurry which has been fed to the separator is screened to separate the desired pulp fibers from the undesired contaminants. The pulp slurry inlet, the accepts outlet, and other parts of the separator are not shown, as a detailed description of such parts is not necessary for an understanding of the invention, such parts being well known to those skilled in the art of pulp and paper making.

A rejects conduit 12 extends outwardly from the bottom of the separator 10. The rejects conduit 12 is connected to an elbow 14 with the elbow connected to an upright conduit 16 leading to flow control valve 18. Fluid flowing through control valve 18 flows through elbow 20 and horizontal pipe 22 to storage.

The flow of the contaminants in suspension is controlled by a flow sensor 24, such as a magnetic flow tube which feeds a signal which is a function of the rate of flow of the fluid in the pipe 16 to flow control box 26. The flow control box 26, in turn, controls the position of the valve 18 through operator 28.

Figure 4:
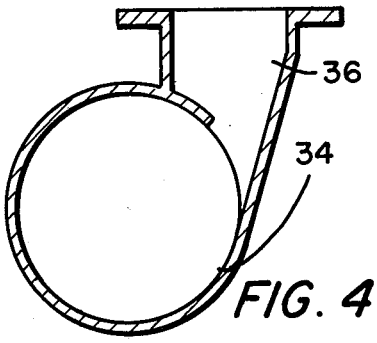
FIG. 4 is a transverse sectional view of the vortex chamber of FIG. 2.
Figure 3:
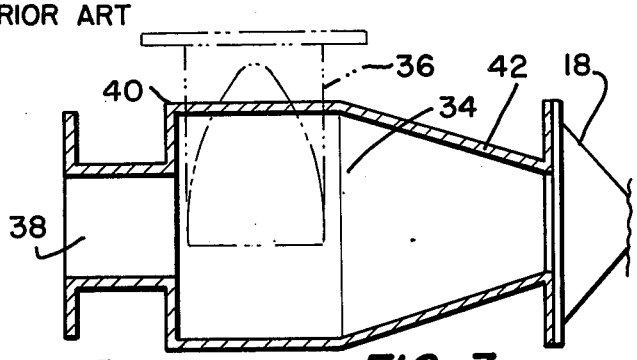
FIG. 3 is a sectional view, on an enlarged scale, showing the vortex chamber of FIG. 2.
Figure 2:
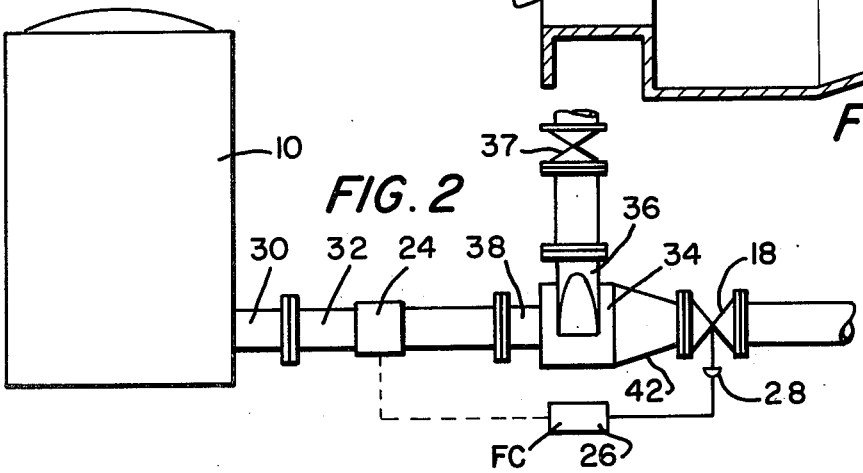
FIG. 2 is a schematic diagram illustrating one embodiment of the invention.
Figure 5:
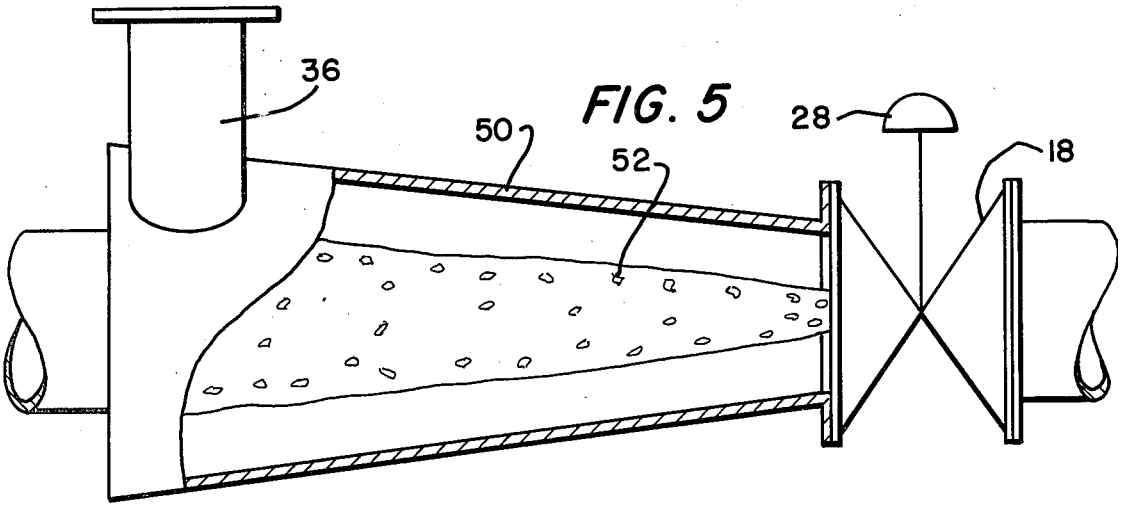
FIG. 5 is a sectional view of a second vortex chamber embodiment.

Unfortunately, with the conventional system of FIG. 1, contaminants tend to bridge the valve orifice and will often plug the valve. To prevent this plugging, one embodiment of my invention is illustrated in FIGS. 2 through 4, and a second embodiment is shown in FIG. 5. Referring to FIG. 2, the suspension containing contaminants is fed through the liquid conduits 30 and 32 to a vortex flow chamber 34. A dilution flow conduit 36 is tangentially connected to the vortex flow chamber 34. The flow in conduit 36 is controlled by control valve 37. As seen more clearly in FIG. 3, the vortex flow chamber 34 includes a fluid inlet 38. The vortex flow chamber 34 should be conical along at least a portion of its length, and in the embodiment of FIGS. 2 through 4 fluid inlet 38 leads into a cylindrical portion 40 of greater diameter than the inlet 38. The conically shaped portion 42 causes the whirling started by the flow of dilution fluid into the vortex chamber through tangential conduit 36 to continuously decrease in diameter so that by the time the contaminants reach the vortex chamber outlet, the contaminants will be confined to a small enough diameter to pass through the small opening in the control valve 18.

In the embodiment shown in FIG. 5, the vortex flow chamber 50 is conically shaped along its entire length.

In practicing my new method of conducting the reject flow from a separator, the reject flow containing the contaminants is conducted to a vortex flow chamber such as flow chamber 34 in FIGS. 2 through 4, or flow chamber 50 in FIG. 5. A tangential liquid flow of sufficient velocity causes the dilution liquid in the chamber to flow in a whirling motion and fast enough to squeeze the flow containing the contaminants, such as contaminants 52, shown in FIG. 5, toward the axis of the vortex flow chamber. Though not shown in FIGS. 2 through 4, the action of the vortex in such Figures is substantially the same as the action shown in FIG. 5, namely, the flow containing the contaminants is squeezed toward the axis of the vortex flow chamber.

The flow containing the contaminants is, therefore, surrounded by an annular layer of dilution liquid and is thus kept away from the walls of the vortex flow chamber and kept flowing along the axis of said chamber and therefore the contaminants pass through the valve aperture with such few contacts that structures of contaminants are unable to form, thus eliminating plugging of the valve and largely reducing the amount of erosive wear of the valve members.

I claim:

1. A method of conducting a rejects flow from a pressure separator used to separate contaminants from the desired cellulose fibers in a wood pulp slurry to a flow restricting device used to lower the pressure at a controlled flow rate comprising the steps of: conducting the rejects flow axially to a vortex flow chamber which is conical along at least a portion of its length preceding its outlet, tangentially flowing a dilution liquid flow into the vortex flow chamber at sufficient velocity to cause the dilution liquid to surround the rejects flow and squeeze the rejects flow into a smaller cross section without significant mixing of the dilution liquid flow and rejects flow as both flows pass through said conical portion of the vortex flow chamber; and conducting the rejects flow and dilution flow from the outlet of the vortex flow chamber to the flow restricting device.

2. The method of claim 1 wherein: the tangential liquid flow into the vortex flow chamber is substantially constant and the flow through the flow restricting device is variable.

3. The method of claim 1 wherein: the tangential liquid flow into the vortex flow chamber is variable and the flow through the flow restricting device is substantially constant.

* * * * *